US005965638A

United States Patent [19]

Heine

[11] Patent Number: 5,965,638

[45] Date of Patent: Oct. 12, 1999

[54] STRUCTURAL MAT MATRIX

[75] Inventor: Darrell Heine, Ennis, Tex.

[73] Assignee: Elk Corporation of Dallas, Dallas, Tex.

[21] Appl. No.: 08/925,890

[22] Filed: Sep. 8, 1997

[51] Int. Cl.[6] ..... B32B 3/26; B32B 5/16

[52] U.S. Cl. ..... 524/13; 524/14; 524/847; 442/173; 442/176; 442/180

[58] Field of Search ..... 524/13, 14, 847; 442/85, 172, 173, 176, 180; 525/163

[56] References Cited

U.S. PATENT DOCUMENTS

| | | | |
|---|---|---|---|
| 3,841,885 | 10/1974 | Jakel | 106/93 |
| 3,954,555 | 5/1976 | Kole et al. | 162/136 |
| 4,112,174 | 9/1978 | Hannes et al. | 428/220 |
| 4,118,272 | 10/1978 | Ziegler et al. | 162/156 |
| 4,129,674 | 12/1978 | Hannes et al. | 428/285 |
| 4,183,782 | 1/1980 | Bondoc | 162/156 |
| 4,200,487 | 4/1980 | Bondoc et al. | 162/135 |
| 4,201,247 | 5/1980 | Shannon | 138/141 |
| 4,220,500 | 9/1980 | Baba et al. | 162/127 |
| 4,229,329 | 10/1980 | Bennett . | |
| 4,233,353 | 11/1980 | Brondoc et al. | 428/141 |
| 4,242,404 | 12/1980 | Bondoc et al. | 428/220 |
| 4,258,098 | 3/1981 | Bondoc et al. | 428/288 |
| 4,269,886 | 5/1981 | Bondoc | 428/219 |
| 4,284,470 | 8/1981 | Bondoc | 162/145 |
| 4,306,911 | 12/1981 | Gordon et al. | 106/99 |
| 4,331,726 | 5/1982 | Cleary | 428/143 |
| 4,373,992 | 2/1983 | Bondoc | 162/145 |
| 4,460,737 | 7/1984 | Evans et al. | 524/584 |
| 4,472,243 | 9/1984 | Bondoc et al. | 162/135 |
| 4,506,060 | 3/1985 | White, Sr. et al. | 525/163 |
| 4,543,158 | 9/1985 | Bondoc et al. | 162/145 |
| 4,555,543 | 11/1985 | Effenberger et al. | 524/520 |
| 4,571,356 | 2/1986 | White, Sr. et al. | 428/143 |
| 4,610,918 | 9/1986 | Effenberger et al. | 428/245 |
| 4,626,289 | 12/1986 | Hsu | 106/287.34 |
| 4,654,235 | 3/1987 | Effenberger et al. | 427/407.3 |
| 4,683,165 | 7/1987 | Lindemann et al. | 428/298 |
| 4,745,032 | 5/1988 | Morrison | 428/215 |
| 5,001,005 | 3/1991 | Blanpied | 428/283 |
| 5,030,507 | 7/1991 | Mudge et al. | 428/288 |
| 5,110,839 | 5/1992 | Chao | 521/83 |
| 5,192,366 | 3/1993 | Nishioka et al. | 106/724 |
| 5,318,844 | 6/1994 | Brandon | 428/357 |
| 5,334,648 | 8/1994 | Drews et al. | 524/112 |
| 5,445,878 | 8/1995 | Mirous | 428/288 |
| 5,518,586 | 5/1996 | Mirous | 162/156 |
| 5,571,596 | 11/1996 | Johnson | 428/143 |
| 5,573,586 | 11/1996 | Yap et al. | 106/668 |
| 5,580,378 | 12/1996 | Shulman | 106/677 |

OTHER PUBLICATIONS

Dialog Citation 329240 PAPERCHEM No.: 53–09240 Opportunities for Glass Fibers in Wet–Laid Nonwovens; Bershas, J.P., INDA Tech. Symp. Nonwovens (Atlanta) 9:43–53 (Mar. 9–11, 1981).

*Primary Examiner*—Nathan M. Nutter
*Attorney, Agent, or Firm*—Baker & Botts, L.L.P.

[57] ABSTRACT

A structural mat matrix comprises (a) a substrate which consists essentially of from 80% to 99% by weight fiberglass fibers and from 20% to 1% by weight wood pulp and (b) a binder which consists essentially of from 80% to 95% by weight urea formaldehyde and from 20% to 5% by weight acrylic copolymer. The binder bonds the substrate fiberglass fibers and wood pulp together and comprises from 5% to 15% by weight of said matrix, preferably 10% by weight of the matrix.

4 Claims, No Drawings

STRUCTURAL MAT MATRIX

BACKGROUND OF INVENTION

This invention relates to a structural mat matrix such as a roofing shingle mat matrix.

For many years, structural articles such as roofing shingles have been comprised of fiberglass substrates coated with a binder which bonds together the fiberglass substrate fibers. Such substrates are nonwoven fiberglass mats which are desirable because they are lighter in weight than previously used mats. Fiberglass mats have also been preferred as roofing shingle substrates because of their fire resistant nature, their resistance to moisture damage, their excellent dimensional stability, their resistance to curl with temperature changes, their resistance to rot and decay, and their ability to accept more highly filled asphalt coatings.

Heretofore, efforts to optimize fiberglass roofing shingle substrates have focused on attempts at improving their tear strength and tensile strength without unduly increasing the weight of the shingle. Heavier shingles and other structural articles are generally more expensive because of greater raw material and transportation costs. Operating within such weight/cost constraints, shingle manufacturers have found that, to improve tear strength, they had to sacrifice tensile strength and vice versa.

U.S. Pat. No. 4,112,174 discloses a mat suitable in the manufacture of roofing products which includes monofilament glass fibers, glass fiber bundles and a relatively small amount of binder, e.g. binder which is 15% by dry weight of the mat. The mat has a weight of between approximately 2.00 and 2.40 lbs/100 square feet. U.S. Pat. No. 4,242,404 discloses a glass fiber mat useful for roofing products which includes individual filament glass fibers and extended glass fiber elements and a binder applied in an amount of about 3% to 45% by weight of the finished mat. The basis weight of the finished mat is described as being at least 1 lb./100 sq. ft and preferably about 2.0 to 3.0 lbs/sq. ft.

U.S. Pat. No. 4,472,243 discloses sheet type roofing material for use in built-up roofing and in the manufacture of roofing shingles. Chopped glass fibers are dispersed in a slurry of cellulosic fibers and binder is added. According to the patent, the material comprises 10–60 wt % glass fibers of varying lengths, 15–80% wt % cellulosic fiber and 5–25% binder. The patent states that the proportions and sizes of cellulosic and glass fibers described therein "provide the desired balance of structural properties" in the material to render it "suitable as substrate for roofing material" to "meet the desired standards for mechanical strength and fire resistance." The patent further notes that the "[g]lass fiber content of the felt of the invention is important in controlling its porosity and skeletal structure. . . . On the high end of glass fiber content the felt substrate tends to be porous with a high order of skeletal structure. Such a felt will uncontrollably absorb excessive amounts of asphaltic saturant at a very high rate during roofing shingle processing and this has a deleterious effect in the spread of flame test due to severe asphaltic filled coating slides."

Surprisingly, the applicant has found that by producing a mat having a relatively high fiberglass content and relatively low cellulosic component and binder contents, the mat matrix has the same physical properties (such as tensile strength) of more costly heavy weight mats, with substantially increased tear strength.

SUMMARY OF THE INVENTION

The present invention is a structural mat matrix which comprises (a) a substrate which consists essentially of from 80% to 99% by weight fiberglass fibers and from 20% to 1% by weight wood pulp and (b) a binder which bonds together the fiberglass fibers and the wood pulp. The binder consists essentially of from 80% to 95% by weight urea formaldehyde resin and from 20% to 5% by weight acrylic copolymer. The binder comprises from 5% to 15% by weight of the matrix, preferably 10%.

In a preferred embodiment, (a) the substrate consists essentially of 95% by weight fiberglass and 5% by weight wood pulp and (b) the binder consists essentially of 90% by weight urea formaldehyde resin and 10% by weight acrylic copolymer.

DETAILED DESCRIPTION

Structural articles of the present invention are useful as, inter alia. roofing shingle mats, built-up roofing mats, facer mats and base plysheets. Articles produced in accordance with the invention are lighter in weight yet possess the same physical properties of tearing strength, tensile strength, wet tensile strength, porosity, and bursting strength as their prior art counterparts. Moreover, the applicant's inventive structural mat matrices achieve those results with lower raw material costs.

The structural mat matrices of the present invention comprise (a) a substrate which consists essentially of from 80% to 99% by weight fiberglass fibers and from 20% to 1% by weight wood pulp and (b) a binder which consists essentially of from 80% to 95% by weight urea formaldehyde resin and from 20% to 5% by weight acrylic copolymer. The fiberglass fibers which may be used in the substrate of the invention include wet chopped, 1" to 1½" length, 14 to 18 micron diameter fibers which may be obtained from Owens Corning Fiberglas, Schuller and PPG Industries, Inc. The wood pulp may be cellulose fibers, cellulose pulp, Kraft pulp, hardwood and softwood pulps which may be obtained from, e.g. International Paper Co., Rayonier, James River and Weyerhaeuser and other market pulp manufacturers.

The urea formaldehyde resin in the binder may be a latex of about 60% solids, such as Casco Resin C511 or Casco Resin FG-413F which may be obtained from Borden Chemical, Inc. The acrylic copolymer may be vinyl acrylic copolymer of about 49% solids such as Franklin International Covinax 830 or Rohm and Haas Rhoplex GL-618. In a preferred embodiment, the binder comprises 10% by weight of the matrix.

Structural mat matrices made in accordance with this invention may be of any shape and may be used in a variety of products including roofing shingles, built-up roofing, facers, etc. Preferably, such matrices are planar in shape.

Additionally, the structural matrices may be coated with a water repellant material. Two such water repellant materials are Aurapel 33R or Aurapel 391 available from the Auralux Corporation of Norwich, Conn. Further, structural matrices made in accordance with the invention may be coated with an antifungal material such as Micro-Chek 11P, an antibacterial material such as Micro-Chek 11-S-160, a surface friction agent such as Byk-375, and/or a coloring dye such as T-1133 A.

The materials used in the making of the matrices and the methods of their preparation are described respectively in the following trade literature: International Paper ALBACEL product literature for bleached southern pine pulp available from International Pulp Sales, 2 Manhattanville Rd., Purchase, N.Y. and International Paper SUPERCELL AO-2 product literature 0047 - 3/97 for fully bleached hardwood kraft pulp available from International Pulp Sales, 1290 Avenue of the Americas, New York, N.Y.; Owens Corning Product Bulletin 786 WUCS (Wet Use Chopped Strands) c. 1995 Owens Corning World Headquarters, Fiberglas Tower, Toledo, Ohio; PPG 8239 WET CHOPPED STRAND bulletin 2.3.1, Revised 2/95, PPG Fiberglass Products, One PPG Place, Pittsburgh, Pa.; Borden Casco Resin C511 DATA SHEET TDS XA-C511 06/97 and Resin FG-413F DATA SHEET TDS XA-413F 11/96, North American Resins Worldwide Packaging and Industrial Products (Div. of Borden Inc.) 520 112$^{th}$ Ave., N.E. Bellevue, Wash.; Franklin International Covinax 830 Data Sheet 3/20/95, Franklin International, 2020 Bruck Street, Columbus, Ohio; Rohm and Haas Rhoplex GL-618 product literature 20N2, September 1994, Rohm and Haas Co., Charlotte, N.C. The disclosures of each of the aforementioned trade publications are incorporated herein by reference.

EXAMPLE I

The applicant developed a structural mat matrix with physical performance characteristics of heavy weight mats achieved at lower basis weight by increasing the fiberglass content of the mat relative to the normal binder content and including a relatively minor amount of wood pulp in the substrate matrix. The matrix was produced as follows:

Laboratory Preparation of Matrix

A 12"×12" Williams Sheet Mold, equipped with a Lightnin mixer mounted on the top rim, was filled with approximately 5 gallons of softened water. Agitation was started and 10 ml. of Nalco 2388 viscosity modifier and 5 ml. of dilute dispersant were added. 5.94 grams of Owens-Corning 786 1" "M" chopped fiber glass (16 micron) were added and mixing continued for 12 minutes. 0.31 gramn of International Paper AO2 Supercell wood pulp was dispersed for 15 seconds in a Waring blender containing 300 ml. of water. The pulp slurry was added to the sheet mold, the water drained and the web formed on the wire at the bottom of the sheet mold. After opening the sheet mold, a more open mesh wire was placed on top of the web, which was transferred and passed over a vacuum slot to remove excess water.

The web was transferred to a third wire and dipped in a rectangular pan containing a 90:10 by weight (solids) mixture of Borden Casco C-511X urea-formaldehyde resin and Franklin International Covinax 830 acrylic latex at 14% total solids. The supported web was passed over a vacuum slot to remove excess saturant and then placed in a circulating air oven set at 400° F. for 2 minutes for drying and curing.

Laboratory Preparation of Shingle Coupon

The filled asphalt coating compound was prepared by heating 350 grams of Trumbull oxidized asphalt in a one-quart sample can equipped with a high-speed mixer and an electrically-heated mantle. When the asphalt temperature reached 400° F., 650 grams of JTM Alsil-04TR fly ash were added slowly with agitation until a uniform blend was obtained.

Precut (7½"×11") release paper was placed in a Pacific-Scientific draw down apparatus. A piece of matrix was mounted on the release paper using transparent tape and the draw down skimmer gauge set to 45 mil (0.045 inch). Hot coating compound (400° F.) was poured in front of the knife, the electric drive turned on and the knife drawn across the length of the matrix sample. Excess coating was removed from the knife and the catch pan. The sample was removed from the apparatus and remounted asphalt side down on a fresh piece of release paper. The skimmer gauge was set to 90 mil (0.090 inch) and the reverse side coated with asphalt compound in the same manner as above.

After cooling to ambient temperature, the coupon, sandwiched between sheets of release paper, was placed in a Carver press, having platens preheated to 250° F., and was pressed at a pressure of 1000 pounds per square inch for 30 seconds, resulting in a final coupon thickness of about 65 mil. (0.065 inch).

EXAMPLES II TO VII

Laboratory handsheet matrix samples were prepared by the same procedure described above for Example I, using the substrate compositions listed in Table 1, the binder compositions listed in Table III and matrix compositions listed in Table V, with the quantities of each raw material calculated to obtain the matrix basis weights listed for each example in Table V.

Example II of the instant invention is a modification of Example I, with the portion of wood pulp in the substrate increased to 10%. Example III is a modification of Example I, in which the binder is 100% urea formaldehyde resin. Example IV is a modification of Example I, having 15% acrylic copolymer resin content in the binder. Example V is a modification of Example I, with no wood pulp in the substrate. Examples VI and VII are matrix samples of conventional composition having basis weights of about 1.4 and 1.8 lb/sq. respectively, to serve as controls.

Single coupons were prepared in an identical manner to that described above for Example I.

EXAMPLES VIII AND IX

Rolls of matrix used in these examples were prepared using conventional paper making equipment commonly used in the roofing mat industry. Binder was added in line with conventional wet-web impregnation equipment. Drying and curing of the matrix rolls were accomplished with gas-fired ovens.

Example VIII is the preferred matrix of the instant invention. Example IX is a standard matrix of higher basis weight and binder content used in the production of shingles and is included to serve as a control.

Shingles were made using conventional roofing shingle production equipment and raw materials and contained granules.

PHYSICAL PROPERTIES

Properties of the matrix samples and shingle coupons of Examples I to VII are shown in Table VII. Those of the production matrixes and shingles of Examples VIII and IX are listed in Table VIII. Standard testing procedures as published by the Technical Association of the Pulp and Paper Industry (Tappi) and the American Society of Testing and Materials (ASTM) with modifications adopted by the roofing industry were used, as described below.

PROCEDURE A

Basis weight of the structural mat matrix was measured according to TAPPI Method T 1011 om-92 using a 10"×10" test specimen cut from a handsheet. The value is reported in pounds per square (100 square feet), as is customary in the roofing industry.

PROCEDURE B

Loss on ignition of the structural mat matrix was tested by TAPPI Method T 1013 om-92; the results being reported as a percentage of the initial matrix weight.

PROCEDURE C

Tensile strength of the structural mat matrix was measured according to ASTM D-828. Jaw width and sample width were both 3 inches; initial gap between jaws was 3 inches; rate of jaw separation was 12 inches per minute, test results are reported in pounds per 3"-wide sample.

PROCEDURE D

Tear resistance of the structural mat matrix was measured according to TAPPI Method T 1006 sp-92, using the Elmendorf tearing tester described in TAPPI Method T 414. A single-ply sample was tested. The results are reported in grams.

PROCEDURE E

Tensile strength of the shingle coupon was tested according to ASTM D-828. Jaw width and sample width were both 2 inches; initial gap between jaws was 3 inches; rate of jaw separation was 2 inches per minute. Test results are reported in pounds per 2"-wide sample.

PROCEDURE F

Tearing resistance of the shingle coupon was measured according to ASTM D-3462 using an Elmendorf tearing tester. Test results are reported in grams.

TABLE I

Formulation of Laboratory Handsheet Substrate (Percent by Weight)

| | Ex. I | Ex. II | Ex. III | Ex. IV | Ex. V | Ex. VI | Ex. VII |
|---|---|---|---|---|---|---|---|
| Fiberglass | 95.0 | 90.0 | 95.0 | 95.0 | 100.0 | 100.0 | 100.0 |
| Wood Pulp | 5.0 | 10.0 | 5.0 | 5.0 | | | |
| Dispersant | 0.025 | 0.025 | 0.025 | 0.025 | 0.025 | 0.025 | 0.025 |
| Viscosity Modifier | 0.013 | 0.013 | 0.013 | 0.013 | 0.013 | 0.013 | 0.013 |

TABLE II

Formulation of Production Substrate (Percent by Weight)

| | Ex. VIII | Ex. IX |
|---|---|---|
| Fiberglass | 95.0 | 100.0 |
| Wood Pulp | 5.0 | |
| Dispersant | 0.025 | 0.025 |
| Viscosity Modifier | 0.013 | 0.013 |

TABLE III

Formulation of Laboratory Handsheet Binder (Percent by Dry Weight)

| | Ex. I | Ex. II | Ex. III | Ex. IV | Ex. V | Ex. VI | Ex. VII |
|---|---|---|---|---|---|---|---|
| Borden FG-413F | | | | | | 95.0 | 95.0 |
| Borden C-511X | 90.0 | 90.0 | 100.0 | 85.0 | 90.0 | | |
| Rohm & Haas GL-618 | | | | | | 5.0 | 5.0 |
| Franklin Covinax 830 | 10.0 | 10.0 | | 15.0 | 10.0 | | |

TABLE IV

Formulation of Production Binder (Percent by Dry Weight)

| | Ex. VIII | Ex. IX |
|---|---|---|
| Borden FG-413F | | 95.0 |
| Borden C-511X | 90.0 | |
| Rohm & Haas GL-618 | | 5.0 |
| Franklin Covinax 830 | 10.0 | |

TABLE V

Laboratory Handsheet Matrix Composition & Basis Weight

| | Ex. I | Ex. II | Ex. III | Ex. IV | Ex. V | Ex. VI | Ex. VII |
|---|---|---|---|---|---|---|---|
| Substrate Portion (%) | 90.0 | 90.0 | 90.0 | 90.0 | 90.0 | 80.0 | 80.0 |
| Binder Portion (%) | 10.0 | 10.0 | 10.0 | 10.0 | 10.0 | 20.0 | 20.0 |
| Basis Wt. (lb/100 $ft^2$) | 1.45 | 1.43 | 1.45 | 1.44 | 1.45 | 1.42 | 1.80 |

TABLE VI

Production Matrix Composition & Basis Weight

| | Ex. VIII | Ex. IX |
|---|---|---|
| Substrate Portion (%) | 90.0 | 80.0 |
| Binder Portion (%) | 10.0 | 20.0 |
| Basis Wt. (lb/100 $ft^2$) | 1.44 | 1.60 |

TABLE VII

Physical Properties of Laboratory Matrix Samples and Laboratory Shingle Coupons

| | Procedure | Ex. I | Ex. II | Ex. III | Ex. IV | Ex. V | Ex. VI | Ex. VII |
|---|---|---|---|---|---|---|---|---|
| MAT MATRIX | | | | | | | | |
| Basis Weight | A | 1.45 | 1.43 | 1.45 | 1.44 | 1.45 | 1.42 | 1.78 |
| Loss on Ignition | B | 15.5 | 18.7 | 14.7 | 14.0 | 11.1 | 20.4 | 19.6 |
| Tensile Strength | C | 97 | 91 | 73 | 85 | 110 | 112 | 130 |
| Tearing Resistance | D | 398 | 387 | 436 | 429 | 401 | 203 | 239 |
| SHINGLE COUPON | | | | | | | | |
| Tensile Strength | E | 170 | 135 | 137 | 155 | 172 | 156 | 178 |
| Tearing Resistance | F | 1309 | 918 | 967 | 1076 | 958 | 836 | 843 |

TABLE VIII

Physical Properties of Production Matrix and Production Shingles

| | Procedure | Ex. VIII | Ex. IX |
|---|---|---|---|
| MATRIX | | | |
| Basis Weight | A | 1.43 | 1.60 |
| Loss on Ignition | B | 15.5 | 21.1 |
| Tensile Strength Machine Direction | C | 85 | 81 |
| Tensile Strength Cross Direction | | 28 | 45 |
| Tearing Resistance Machine Direction | D | 344 | 311 |
| Tearing Resistance Cross Direction | | 408 | 429 |
| SHINGLE | | | |
| Tensile Strength Machine Direction | E | 178 | 151 |
| Tensile Strength Cross Direction | | 80 | 91 |
| Tearing Resistance Machine Direction | F | 1167 | 1103 |
| Tearing Resistance Cross Direction | | 1392 | 1123 |

Surprisingly, the applicant has discovered that by reducing the binder content and increasing the overall fiber amount and including a relatively minor amount of wood pulp, the desired weight of the mat can be achieved while dramatically improving tear strength of the matrix and the shingle produced from the matrix. Although not wishing to be bound by any particular theory, the applicant believes that the wood pulp cellulosic component of the matrix in the invention bridges the glass fibers to enhance tensile strength, thereby permitting a decrease in binder content and an increase in fiberglass content to provide the surprising results noted in Tables VII and VIII above.

It should be understood that the above examples are illustrative, and that components other than those described above can be used while utilizing the principles underlying the present invention. For example, other sources of wood pulp as well as mixtures of urea formaldehyde and/or acrylic latices can be used in formulating the matrices. Other suitable types of latex can be used in combination with urea formaldehyde to improve the properties of the matrices, provided that fiberglass comprises the major proportion of the matrix. The matrices can be employed in roofing materials such as roofing shingles, built-up roofing, rolled roofing and other products such as facer, etc.

What is claimed is:

1. A structural mat matrix which comprises:

a) a substrate which consists essentially of from 80% to 99% by weight fiberglass fibers and from 20% to 1% by weight wood pulp; and b) a binder which consists essentially of from 80% to 95% by weight urea formaldehyde resin and from 20% to 5% by weight acrylic copolymer;

wherein said binder bonds the substrate fiberglass fibers and wood pulp together and wherein said binder comprises from 5% to 15% by weight of said matrix.

2. A structural mat matrix according to claim 1 wherein said binder comprises 10% by weight of said matrix.

3. A structural mat matrix according to claim 2 which comprises a) a substrate which consists essentially of 95% by weight fiberglass and 5% by weight wood pulp; and b) a binder which consists essentially of 90% by weight urea formaldehyde resin and 10% by weight acrylic copolymer.

4. A structural mat matrix according to claim 3 in which said acrylic copolymer is a vinyl acrylic copolymer.

* * * * *